US006397801B2

(12) United States Patent
Golovatai-Schmidt

(10) Patent No.: US 6,397,801 B2
(45) Date of Patent: Jun. 4, 2002

(54) VALVE TIMING CONTROL APPARATUS OF AN INTERNAL COMBUSTION ENGINE

(75) Inventor: Eduard Golovatai-Schmidt, Rottenbach (DE)

(73) Assignee: Ina Wälzlager Schaeffler ohg, Herzogenaurach (DE)

( * ) Notice: Subject to any disclaimer, the term of this patent is extended or adjusted under 35 U.S.C. 154(b) by 0 days.

(21) Appl. No.: 09/804,528

(22) Filed: Mar. 12, 2001

(30) Foreign Application Priority Data

Mar. 18, 2000 (DE) ..... 100 13 479

(51) Int. Cl.[7] ..... F01L 1/34
(52) U.S. Cl. ..... 123/90.15; 123/90.17
(58) Field of Search ..... 123/90.15, 90.17, 123/90.37; 464/1, 2, 160

(56) References Cited

U.S. PATENT DOCUMENTS

| | | | | | |
|---|---|---|---|---|---|
| 5,297,507 | A | * | 3/1994 | Ma | 123/90.17 |
| 5,520,145 | A | * | 5/1996 | Nagai et al. | 123/90.17 |
| 5,870,983 | A | * | 2/1999 | Sato et al. | 123/90.17 |
| 5,875,750 | A | * | 3/1999 | Iwaskai | 123/90.17 |
| 6,135,077 | A | * | 10/2000 | Moriya | 123/90.17 |
| 6,170,446 | B1 | * | 1/2001 | Hashimoto et al. | 123/90.15 |
| 6,302,072 | B1 | * | 10/2001 | Sekiya et al. | 123/90.17 |

FOREIGN PATENT DOCUMENTS

| | | |
|---|---|---|
| DE | 197 26 300 A1 | 1/1998 |
| DE | 197 45 908 A1 | 4/1999 |

* cited by examiner

*Primary Examiner*—Thomas Denion
*Assistant Examiner*—Ching Chang
(74) *Attorney, Agent, or Firm*—Henry M. Feiereisen

(57) ABSTRACT

A valve timing control apparatus, includes a drive wheel in driving relation with the crankshaft and has a hollow space with at least one hydraulic working chamber demarcated by two boundary walls extending inwardly from an inner wall surface of the drive wheel. Mounted in fixed rotative engagement with the camshaft and fitted in the hollow space of the drive wheel is a rotatable impeller having at least one vane to subdivide the working chamber in two hydraulic pressure compartments. A seal, positioned between a free end face of the vane of the impeller and the inner wall surface of the drive wheel, fluidly seals the pressure compartments from one another and is formed by a roller-type sealing member spring-mounted in radial direction in an axial groove of the vane. The inner wall surface forms for the sealing member a slanted ramp surface which extends radially outwards in a rotation direction of the impeller, so that a torque is transmittable onto the impeller by a tangential force component resulting from a combination of the slanted ramp surface of the drive wheel and a radial spring force of the sealing member applied upon the impeller.

20 Claims, 3 Drawing Sheets

VALVE TIMING CONTROL APPARATUS OF AN INTERNAL COMBUSTION ENGINE

CROSS-REFERENCES TO RELATED APPLICATIONS

This application claims the priority of German Patent Application, Ser. No. 100 13 479.3, filed Mar. 18, 2000, the subject matter of which is incorporated herein by reference.

BACKGROUND OF THE INVENTION

The present invention relates, in general, to a valve timing control apparatus for an internal combustion engine, and more particularly to a valve timing control apparatus for application as a hydraulic camshaft adjustment device of rotary piston type configuration.

German Pat. No. 197 26 300 A1 describes a valve timing control apparatus as so-called rotation-type adjustment device which includes a drive shaft, configured as outer rotor in driving relationship with a crankshaft of the internal combustion engine, and an impeller, configured as inner rotor and mounted in fixed rotative engagement on the camshaft of the internal combustion engine. The drive wheel defines a hollow space, which is demarcated by a cylindrical peripheral wall and two sidewalls, for accommodating the impeller. The hollow space is divided in three hydraulic working chambers formed by three boundary walls extending inwardly from the peripheral wall in the direction of the center axis of the drive wheel. The impeller has thus three vanes radially extending from a hub into the working chambers of the drive wheel. As a consequence, each working chamber is subdivided into two hydraulic pressure compartments which are fluidly sealed from one another by seals, disposed between the hub of the impeller and the boundary wall of the drive wheel as well as between the free end face of each vane of the impeller and the inner wall surface of the peripheral wall of the drive wheel. When hydraulic fluid is admitted selectively or simultaneously into the pressure compartments, the impeller is rotated or fixed in place with respect to the drive wheel and thus the camshaft is rotated or fixed in place relative to the crankshaft. A torsional spring, disposed in a separate space, extends between the impeller and the drive wheel for applying auxiliary energy to match different adjustment speeds, resulting from the camshaft friction, in both rotation directions of the device, on the one hand, and to rotate the camshaft into a base or starting position that is preferred at the start of the internal combustion engine, after the internal combustion engine has been shut down or in the event the pressure of the hydraulic fluid in insufficient to adjust the apparatus. The camshaft is held in the starting position during start of the internal combustion engine in addition by a separate locking mechanism for mechanically coupling the impeller with the drive wheel. The locking mechanism is substantially configured as stopper, which is resiliently received in a vane of the impeller and axially shiftable in a pocket of a sidewall of the drive wheel, with the stopper hydraulically connected with the pressure compartments of the apparatus and releasable when the apparatus is acted upon by hydraulic fluid again.

This conventional valve timing control apparatus suffers shortcomings because matching of the adjustment speeds and the rotation of the camshaft into the starting position of the camshaft at start of the internal combustion engine is realized by an additional spring, resulting in a significant increase in size of the axial installation space. In order to apply the required torque, the spring must be sized accordingly, and thus needs sufficient space, which may lead up to a doubling of the necessary axial installation space. Moreover, the spring represents an additional component so that fabrication and assembly results in an increase of production costs of the valve timing control apparatus. Another drawback is the required separate locking mechanism for implementing a mechanical coupling between the impeller and the drive wheel to hold the starting position of the camshaft during start of the internal combustion engine, because the resiliently supported stopper is also composed of a plurality of additional components and thus complicates the fabrication and assembly and ultimately to higher production costs for the valve timing control apparatus.

It would therefore be desirable and advantageous to provide an improved valve timing control apparatus, which obviates prior art shortcomings and is simple in structure and yet reliable in operation.

SUMMARY OF THE INVENTION

According to one aspect of the present invention, an apparatus for adjusting a rotational relation between a camshaft and a crankshaft of an internal combustion engine, includes a drive wheel configured as outer rotor in driving relation with the crankshaft and including a cylindrical peripheral wall and two sidewalls for formation of a hollow space which defines at least one hydraulic working chamber demarcated by two boundary walls extending inwardly from an inner wall surface of the peripheral wall in the direction of the center axis of the drive wheel, a rotatable impeller mounted in fixed rotative engagement with the camshaft and configured as inner rotor fitted in the hollow space of the drive wheel and having a wheel hub and at least one vane extending radially out from the wheel hub into the working chamber of the drive wheel to thereby subdivide the working chamber in two hydraulic pressure compartments acting in opposition to one another through selective or simultaneous admission of hydraulic fluid to thereby effect a rotation or fixation of the impeller with respect to the drive wheel and thus of the camshaft relative to the crankshaft, and a seal, positioned between a free end face of the vane of the impeller and the inner wall surface of the peripheral wall of the drive wheel, for fluidly sealing the pressure compartments from one another, with the seal formed by a roller-type sealing member spring-mounted in radial direction in an axial groove, wherein the inner wall surface forms for the sealing member a slanted ramp surface which extends radially outwards in a rotation direction of the impeller, so that a torque is transmittable onto the impeller by a tangential force component resulting from a combination of the slanted ramp surface of the drive wheel and a radial spring force of the sealing member applied upon the impeller, thereby matching adjustment speeds of the apparatus in both rotation directions during operation of the internal combustion engine and automatically rotating the impeller into a desired starting position of the camshaft, when shutting down the internal combustion engine, thereby mechanically coupling the impeller and the drive wheel, when the camshaft is in the starting position.

According to another feature of the present invention, the coupling between the impeller and the drive wheel can be released through suitable admission of hydraulic fluid into the respective one of the pressure compartments.

According to another feature of the present invention, all seals arranged at the vanes of the impeller may be formed as spring-biased roller-type sealing members and accordingly all portions of the inner wall surface of the peripheral wall of the impeller in the working chambers may be configured as radially outwardly extending ramp surfaces. Such construction results in an increase of the effective mean torque acting on the impeller. Of course, depending on the number of vanes of the impeller, it may also be possible to configure only seals of some vanes as roller-type sealing members and to configure the pertaining portions of the inner wall surface of the peripheral wall of the impeller as outwardly extending ramp surfaces to implement an effective mean torque. Further measures, such as modification of the ramp angle of the ramp surfaces and/or modification of the radial spring force of the sealing members may also be used to suit the effective means torque to conditions of the internal combustion engine at hand.

According to another feature of the present invention, the roller-type sealing members may be supported upon the vanes of the impeller by slide shoes having a top side, formed as a half-round bearing shell, and a bottom side acted upon by a spring. Thus, despite the relatively high radial spring force applied by the springs for urging the sealing members against the inside wall surface of the peripheral wall of the impeller, the configuration of the top side of the slide shoes as bearing shells as well as the lubrication by means of the hydraulic fluid ensure that the sealing members properly roll along the ramp surfaces and are prevented from jamming.

Suitably, the springs are configured as helical compression springs which are fitted in radial boreholes in the vanes of the impeller, with the boreholes terminating at the axial groove of the sealing members, for accommodating the spring. Helical compression springs are suitable as relatively high forces can be realized when being accordingly sized so that the magnitude of the mean torque applied upon the impeller can be suited to the situation at hand. Of course other constructions of spring elements are possible as well, such as, for example, chimney springs or elastomeric spring-type cushions, received in respective receptacles in the vanes of the impeller.

According to another feature of the present invention, the axial groove may have a width, which substantially corresponds to a diameter of the sealing member and exceeds a diameter of the borehole. In this way, sealing gaps are formed between the sealing members and the groove walls of the axial grooves to allow the required turning of the sealing members during rotation of the impeller, on the one hand, and to prevent fluid leakages between the pressure compartments of the hydraulic working chambers via the axial grooves. The depth of the axial grooves is suitably so sized that the sealing member can be almost entirely received therein so as to avoid a contacting of the slide shoes upon the groove base, when the sealing members are positioned at the radially innermost area of the ramp surface. This position normally corresponds to one of the two end positions of the vanes of the impeller upon the boundary walls of the drive wheel, whereby in this end position the spring elements of the sealing members apply a greatest spring force and thus realize a maximum torque upon the impeller.

According to another feature of the present invention, the ramp surfaces are formed with a depression in a region of a rotation position of the impeller corresponding to the desired starting position of the camshaft, for reinforcing a holding moment of the sealing member, resulting from the coupling of the impeller with the drive wheel by force, by an additional positive engagement. The depression may be formed as a stepped recessed axial area having a slanted transition at a juncture to the ramp surface. Taking into account the width of the vanes of the impeller, the recessed area is so arranged that the impeller is blocked in one rotation direction through abutment of its vanes upon the boundary walls of the drive wheel, whereas the other rotation direction of the impeller is barred in positive manner through impact of the sealing members upon the slanted transitions as well as in non-positive manner through the spring force of the spring elements of the sealing members.

In accordance with a variation, the depression may also be configured as an axial trough having a hemispherical profile at a radius corresponding to a radius of the sealing member. The depression is incorporated in the ramp surface such that the impeller can be locked in place in both rotation directions, shortly before impact of the vanes upon the boundary walls, in positive manner through engagement of the sealing members in the troughs as well as in non-positive manner by the spring force applied by the spring elements upon the sealing members.

Regardless of the configuration of the local depressions in the ramp surfaces, the impeller is coupled with the drive wheel only when the hydraulic pressure fails to adjust the impeller, e.g. at shutdown of the engine, so that through admission of hydraulic fluid into the pressure compartment that is of minimum volume at coupling position of the impeller, the coupling of the impeller with the drive wheel is reversed again hydraulically.

A valve timing control apparatus in accordance with the present invention has many advantages compared to conventional apparatuses. The need for a separate spring element that significantly enlarges the axial installation space is eliminated to provide the required auxiliary energy between the impeller and the drive wheel for matching the adjustment speeds of the apparatus and for rotating the camshaft into the starting position desired at the start of the internal combustion engine. Rather, the transmission of a torque upon the impeller is implemented in accordance with the present invention by a tangential force component resulting from the slanted ramp surface of the drive wheel and the radial spring force of each roller-type sealing member. Thus, space demands for an additional spring element are reduced and fabrication of such a separate spring element is avoided so that fabrication and assembly costs can be significantly reduced. By integrating in the function of the sealing members and the ramp surfaces at the same time the function of a locking mechanism to mechanically couple the impeller with the drive wheel in the starting position of the camshaft, the need for a separate locking mechanism and the ensuing complexity in conjunction with fabrication and assembly can be saved and the production costs can be further reduced.

BRIEF DESCRIPTION OF THE DRAWING

Other features and advantages of the present invention will be more readily apparent upon reading the following description of preferred exemplified embodiments of the invention with reference to the accompanying drawing, in which.

DETAILED DESCRIPTION OF PREFERRED EMBODIMENTS

Figure 1:
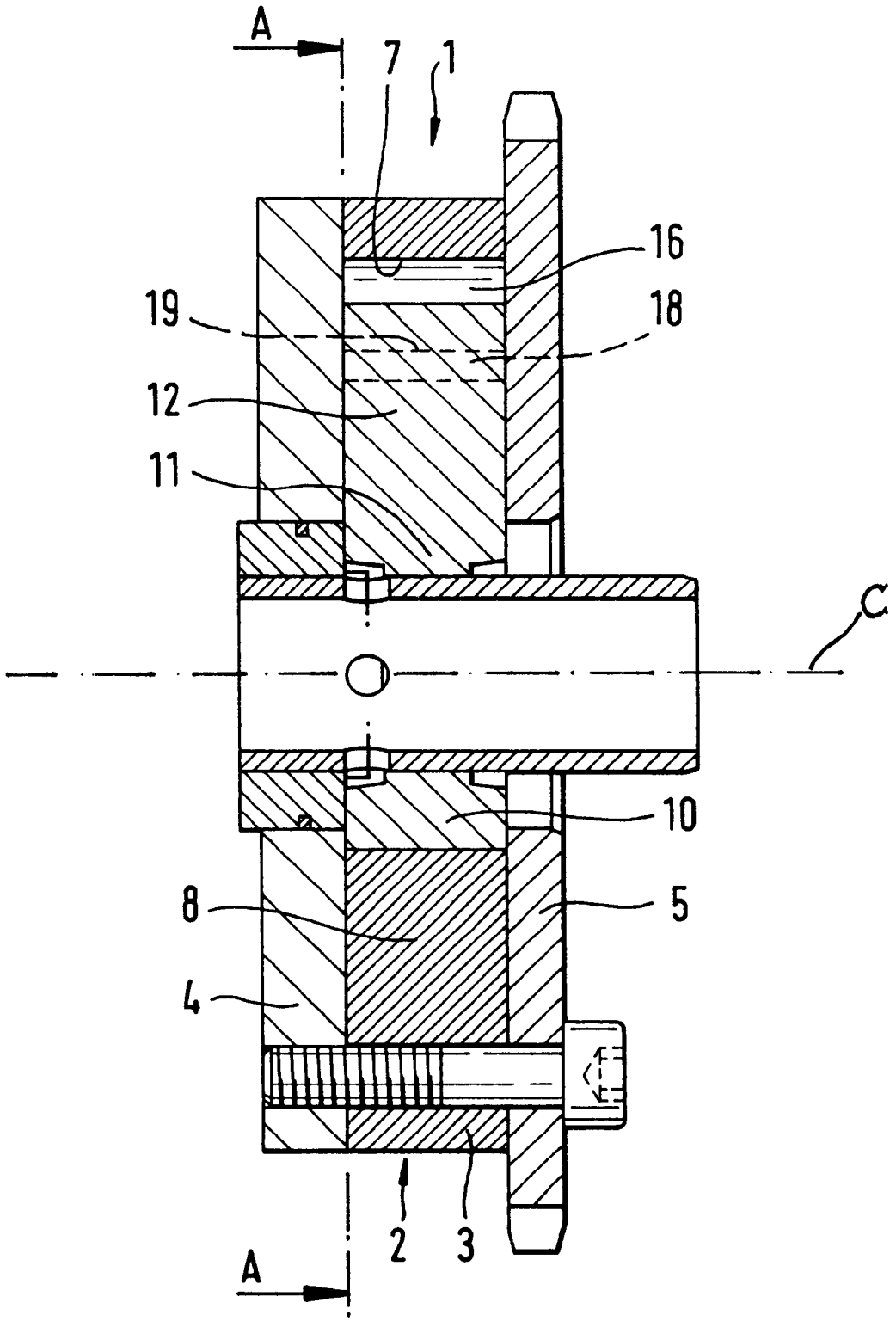
FIG. 1 is a cross sectional view of a valve timing control apparatus according to the present invention.

Throughout all the Figures, same or corresponding elements are generally indicated by same reference numerals.

Turning now to the drawing, and in particular to FIG. 1, there is shown a cross sectional view of a valve timing control apparatus according to the present invention, generally designated by reference numeral 1 for application as hydraulic camshaft adjustment. The valve timing control apparatus 1 is designed as a rotary piston type unit for attachment to a, not shown, camshaft to allow variations of a rotational relation between the camshaft and a crankshaft (not shown) of an internal combustion engine to thereby open and close gas exchange valves (not shown).

The valve timing control apparatus 1 substantially includes a drive wheel 2, which forms an outer drive-side rotor and is operatively connected to the crankshaft of the internal combustion engine, and an impeller 10, which forms an inner driven-side rotor and is mounted in fixed rotative engagement to the camshaft of the internal combustion engine. The drive wheel 2 is defined by a center axis C and has a cylindrical peripheral wall 3 and two sidewalls 4, 5 arranged in spaced-apart disposition on either side of the peripheral wall 3 to define a hollow space 6 in which the impeller 10 is fitted. As shown in particular in FIG. 2, which is a sectional view taken along the line II—II in FIG. 1, the drive wheel 2 includes four boundary walls 4 projecting inwardly from the inner wall surface 7 of the peripheral wall 3 in the direction toward the center axis C to thereby define four hydraulic working chambers 9.

The impeller 10 includes a hub 11 and a four vanes 12 extending radially out from the periphery of the hub 11 for projection into the working chambers 9 in one-to-one correspondence, thereby subdividing each working chamber in two pressure compartments 13, 14, acting in opposite directions through admission of hydraulic fluid through suitable passageways. Of course, the provision of four working chambers and four vanes is done by way of example only, and other configurations which generally follow the concepts outlined here are considered to be covered by this disclosure.

Figure 2:
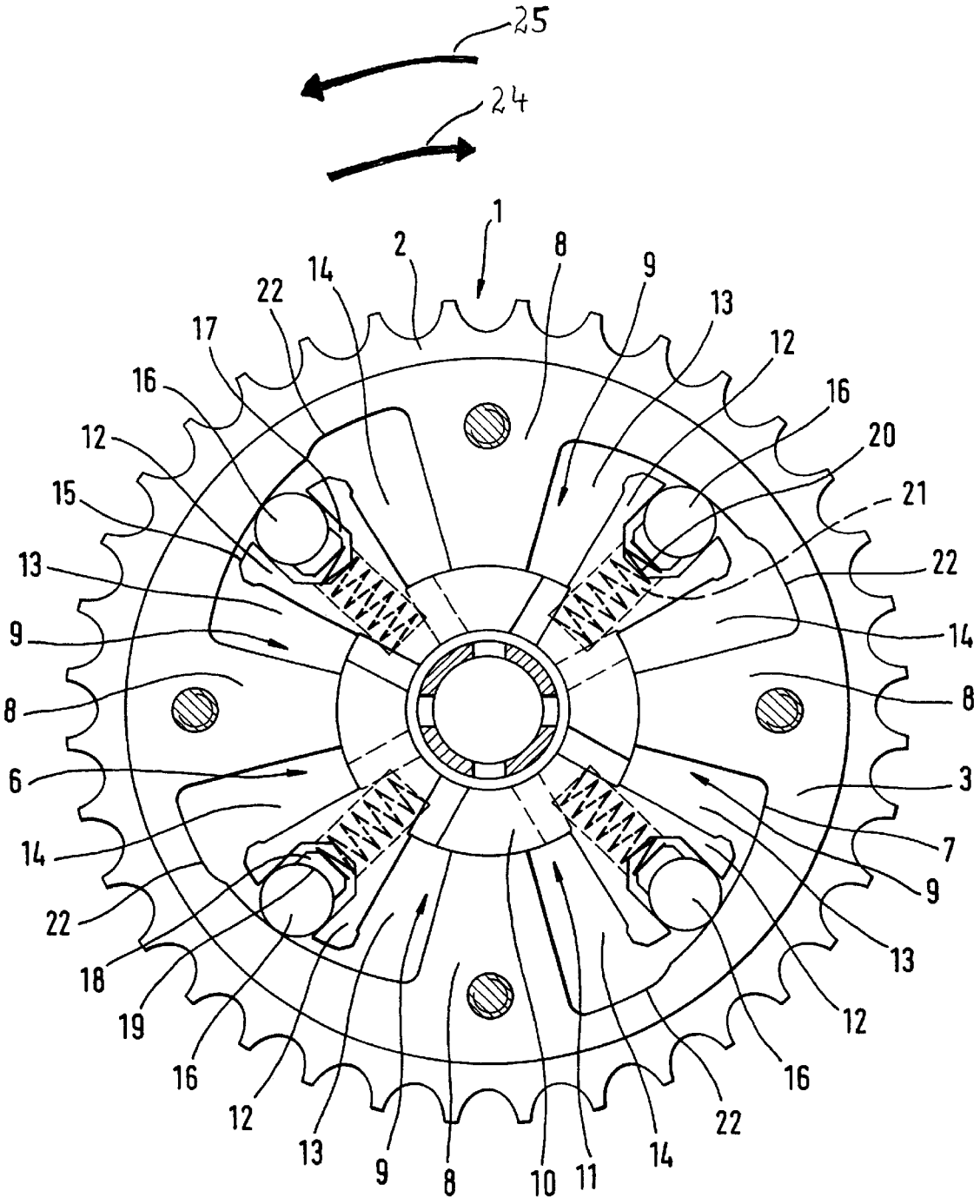
FIG. 2 is a sectional view of the valve timing control apparatus, taken along the line II—II in FIG. 1.

As shown in particular in FIG. 2, the pressure compartments 13, 14 of each working chamber 9 are fluidly sealed from one another by a roller-type sealing member 6 disposed between a free end face 15 of the associated vane 12 of the impeller 10 and the inner wall surface 7 of the peripheral wall 3 of the drive wheel 2. Hydraulic fluid can be admitted selectively or simultaneously into the pressure compartments 13, 14 to thereby implement a rotation or fixation of the impeller 10 with respect to the drive wheel 2 and thus of the camshaft relative to the crankshaft.

Each of the vanes 12 includes a radial borehole 21 for accommodating a spring element 20, such as a helical compression spring, extending between the base of the borehole 21 and a bottom side of a slide shoe 18 which has a top side in the form of a half-round bearing shell 19. The borehole 21 terminates at an axial groove 17 formed at the free end face 15 of each vane 12 for supporting the sealing member 16 in a resilient manner in conjunction with the bearing shell 19 of the slide shoe 18. As the vanes 12 in the working chambers 6 are of an identical construction, it will be understood by persons skilled in the art that a description of one of the vanes 12 is equally applicable to the other vanes 12. The sealing member 16 rolls on portions of the inner wall surface 7 of the peripheral wall 3 in the working chamber 9, whereby the portions are configured as slanted ramp surfaces, which extend radially outwards in rotation direction, indicated by arrow 24, of the impeller 10.

As a consequence of the configuration of the sealing member 16 in the form of a spring-biased roller and the inner wall surface 7 of the peripheral wall 3 in the form of a slanted ramp surface, the interaction of the ramp slant and the radial spring force results in a tangential force component which transmits upon the impeller 10 a torque by which the adjustment speeds of the apparatus are matched in both rotation directions during operation of the internal combustion engine, on the one hand, and the impeller 10 is rotated into the desired starting position for the camshaft at start of the internal combustion engine, after shutdown of the engine, whereby the impeller 10 and the drive wheel 2 are coupled in this starting position in a non-positive and positive manner.

The axial groove 17 of each vane 12 has a width, which substantially corresponds to a diameter of the sealing member 16 and exceeds a diameter of the borehole 21, and a depth which is so sized that the sealing member 16 can be almost entirely received in the axial groove 17, thereby preventing an impact of the slide shoe 18 upon the base of the borehole 21, when the sealing member 16 is moved to the radially innermost area of the ramp surface of the inner wall surface 7.

As further shown in FIG. 2, the ramp surface of the inner wall surface 7 is formed in proximity of the radially outermost area, which corresponds to a rotation position of the impeller commensurate with the desired starting position of the camshaft, with a local depression 22 by which the holding force of the sealing members 16 as a result of the engagement of the impeller 10 with the drive wheel 2 by force, is reinforced by an additional positive engagement. The depression 22 is formed by a step-shaped recessed area in the ramp surface with a slanted transition from the recessed area 22 to the ramp surface. By means of the recessed area 22, the impeller 10 is blocked in the rotation direction 24 through abutment of the vanes 12 upon the boundary walls 8 of the drive wheel 2, and blocked in the other rotation direction, indicated by arrow 25, in positive manner through abutment by the sealing members 16 upon the slanted transitions of the recessed area 22 as well as in non-positive manner by the spring force applied by the springs elements 20 upon the sealing members 16.

Figure 3:
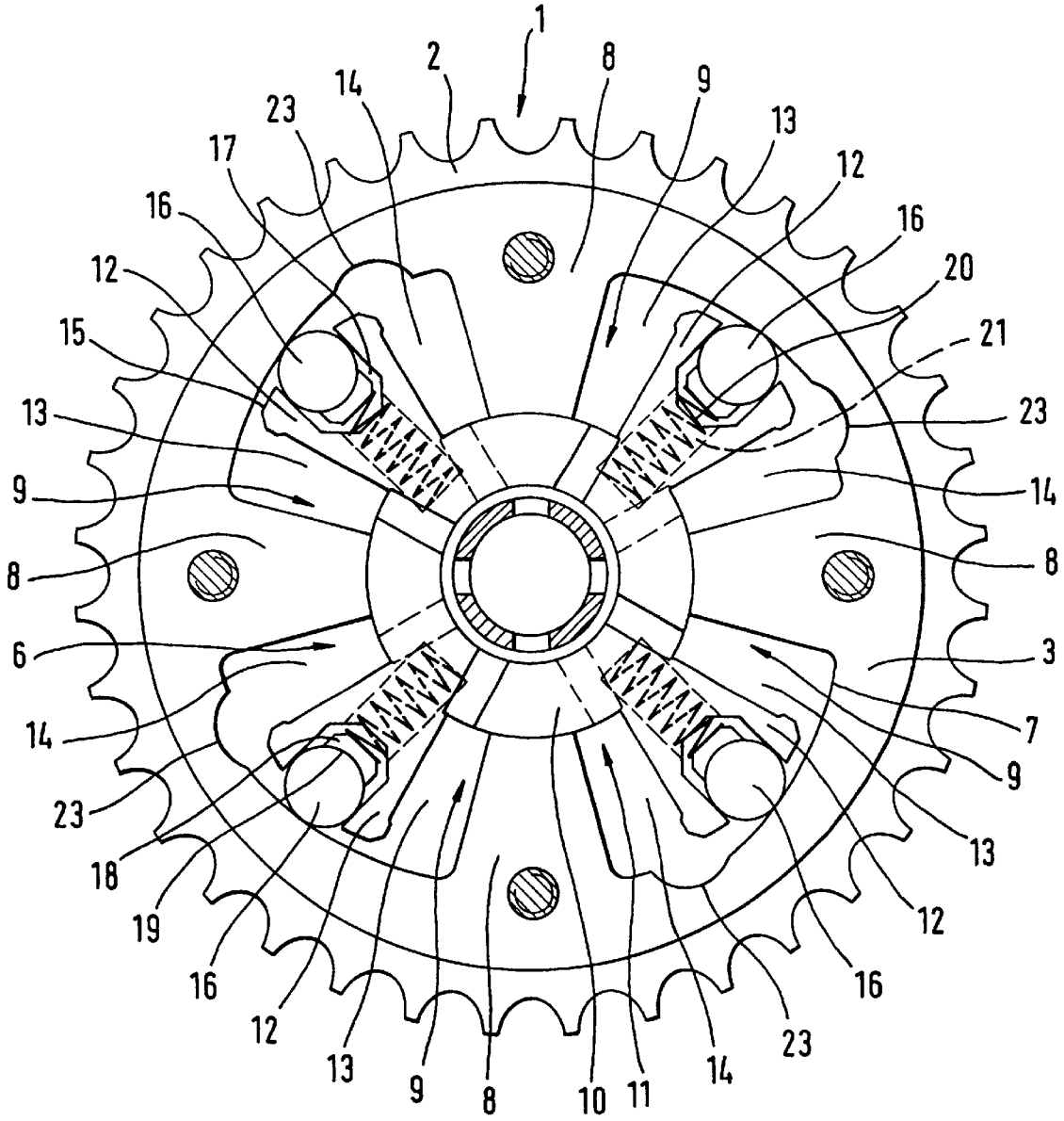
FIG. 3 is a sectional view of a variation of the valve timing control apparatus of FIG. 1.

Turning now to FIG. 3, there is shown a sectional view of a variation of the valve timing control apparatus of FIG. 1. Parts corresponding with those in FIG. 2 are denoted by identical reference numerals and not explained again. In this embodiment, provision is made for depressions in the form of half-round axial troughs 23 having a radius in correspondence with a radius of the sealing members 16. The axial troughs 23 are so incorporated in the ramp surface of the inner wall surface 7 that the impeller 10 can be locked in place in both rotation directions, shortly before impact of the vanes 12 upon the boundary walls 8, in positive manner through engagement of the sealing members 16 in the troughs 23 as well as in non-positive manner by the spring force applied by the spring elements 20 upon the sealing members 16.

Both configurations of mechanical coupling between the impeller 10 and the drive wheel 12, as shown in FIGS. 2 and 3, are automatically released only after buildup of sufficient pressure through admission of hydraulic fluid in the pressure compartment 14, minimized in volume, of each working chamber 9 to rotate the impeller 10 in rotation direction 25.

While the invention has been illustrated and described as embodied in a valve timing control apparatus of an internal combustion engine, it is not intended to be limited to the details shown since various modifications and structural changes may be made without departing in any way from the spirit of the present invention.

What is claimed as new and desired to be protected by Letters Patent is set forth in the appended claims:

1. Apparatus for adjusting a rotational relation between a camshaft and a crankshaft of an internal combustion engine, comprising:

a drive wheel configured as outer rotor in driving relation with the crankshaft and defining a center axis, said drive wheel including a cylindrical peripheral wall and two sidewalls for formation of a hollow space which defines at least one hydraulic working chamber demarcated by two boundary walls extending inwardly from an inner wall surface of the peripheral wall in the direction of the center axis;

a rotatable impeller configured as inner rotor and mounted in fixed rotative engagement with the camshaft, said impeller fitted in the hollow space of the drive wheel and having a wheel hub and at least one vane extending radially out from the wheel hub into the working chamber of the drive wheel to thereby subdivide the working chamber in two hydraulic pressure compartments acting in opposition to one another through selective or simultaneous admission of hydraulic fluid to thereby effect a rotation or fixation of the impeller with respect to the drive wheel and thus of the camshaft relative to the crankshaft; and a seal, positioned between a free end face of the vane of the impeller and the inner wall surface of the peripheral wall of the drive wheel, for fluidly sealing the pressure compartments from one another, said seal being formed by a roller-type sealing member spring-mounted in radial direction in an axial groove, with the inner wall surface forming for the sealing member a slanted ramp surface which extends radially outwards in a rotation direction of the impeller, so that a torque is transmittable onto the impeller by a tangential force component resulting from a combination of the slanted ramp surface of the drive wheel and a radial spring force of the sealing member applied upon the impeller, thereby matching adjustment speeds of the apparatus in both rotation directions during operation of the internal combustion engine and automatically rotating the impeller into a desired starting position of the camshaft, when shutting down the internal combustion engine, thereby mechanically coupling the impeller and the drive wheel, when the camshaft is in the starting position.

2. The apparatus of claim 1, wherein the coupling between the impeller and the drive wheel is releasable through admission of hydraulic fluid into a respective one of the pressure compartments.

3. The apparatus of claim 1, wherein the impeller and the drive wheel are coupled in the starting position of the camshaft in at least one of a positive engagement and non-positive engagement.

4. The apparatus of claim 1, wherein the impeller has a plurality of said vane and a plurality of said seal in one-to-one correspondence for interaction with ramp surfaces of the inner wall surface.

5. The apparatus of claim 1, wherein the vane includes a slide shoe for supporting the sealing member, said slide shoe having a top side, formed as a half-round bearing shell, and a bottom side acted upon by a spring.

6. The apparatus of claim 1, wherein the vane includes a borehole, terminating at the axial groove, for accommodating the spring and, said axial groove having a width, which substantially corresponds to a diameter of the sealing member and exceeds a diameter of the borehole, and a depth which is so sized that the sealing member is almost entirely receivable therein.

7. The apparatus of claim 1, wherein the ramp surface is formed with a depression in a region of a rotation position of the impeller corresponding to the desired starting position of the camshaft, for reinforcing a holding moment of the sealing member, resulting from the coupling of the impeller with the drive wheel by force, by an additional positive engagement.

8. The apparatus of claim 7, wherein the depression is formed as a recessed axial area having a slanted transition at a juncture to the ramp surface.

9. The apparatus of claim 7, wherein the depression is formed as an axial trough having a hemispherical profile at a radius corresponding to a radius of the sealing member.

10. Apparatus for adjusting a rotational relation between a camshaft and a crankshaft of an internal combustion engine, comprising:

a drive wheel in driving relation with the crankshaft, said drive wheel having an interior subdivided in several working chambers, with each of the working chambers demarcated by an inner wall surface of the drive wheel;

a rotor mounted in fixed rotative engagement with the camshaft, said rotor fitted in the interior of the drive wheel and having a plurality of radial vanes to subdivide each of the working chambers in two hydraulic pressure compartments; and a plurality of roller-type, spring-biased sealing members, each of the sealing members being disposed between an end face of a corresponding one of the vanes and an inner wall surface of the drive wheel for fluidly sealing the pressure compartments from one another, whereby the sealing members and the vanes are placed into one-to-one correspondence;

wherein the inner wall surfaces of the working chambers are each configured as a slanted ramp surface, which extends radially outwards in a rotation direction of the rotor, and so interact with the sealing members that the rotor and the drive wheel are mechanically coupled in a desired starting position of the camshaft by a tangential force component resulting from a combination of the slanted ramp surface of each of the inner wall surfaces of the drive wheel and a radial spring force of the sealing members applied upon the rotor.

11. The apparatus of claim 10, wherein the coupling between the rotor and the drive wheel in the starting position of the camshaft is releasable through admission of hydraulic fluid into a respective one of the pressure compartments.

12. The apparatus of claim 10, wherein each of the vanes includes a slide shoe for supporting the sealing members, said slide shoe having a top side, formed as a half-round bearing shell, and a bottom side acted upon by a spring.

13. The apparatus of claim 12, wherein each of the vanes includes a borehole for accommodating the spring and has an end face formed with an axial groove for receiving the sealing member, said axial groove having a width, which substantially corresponds to a diameter of the sealing member and exceeds a diameter of the borehole, and a depth which is so sized that the sealing member is almost entirely receivable therein.

14. The apparatus of claim 10, wherein the inner wall surfaces are each formed with a depression in a region of a rotation position of the rotor commensurate with the desired starting position of the camshaft, thereby additionally locking the sealing member in a positive manner.

15. The apparatus of claim 14, wherein the depression is formed as a recessed area having a slanted transition at a juncture to the ramp surface.

16. The apparatus of claim 14, wherein the depression is formed as an axial trough having a hemispherical profile at a radius corresponding to a radius of the sealing member.

17. A valve timing control apparatus for an internal combustion engine, comprising:

a drive-side structure secured to a crankshaft; and a driven-side structure secured to a camshaft and moving between two end positions relative to the drive-side structure, said driven-side structure having a roller-type, spring-biased sealing member rolling on an inner wall surface of the drive-side structure;

wherein the inner wall surface is configured as a slanted ramp surface, which extends radially outwards and so interacts with the sealing member as to mechanically couple the drive-side structure and the driven-side structure in one of the end positions, commensurate with a starting position of the camshaft, by a tangential force component generated as the sealing member rolls on the slanted ramp surface at application of a radial spring force.

18. The apparatus of claim 17, wherein the inner wall surface is formed with a depression in the region of the one of the end positions, thereby additionally locking the sealing member in a positive manner.

19. The apparatus of claim 18, wherein the depression is formed as a recessed area having a slanted transition at a juncture to the ramp surface.

20. The apparatus of claim 18, wherein the depression is formed as an axial trough having a hemispherical profile at a radius corresponding to a radius of the sealing member.

* * * * *